US005191823A

United States Patent [19]

Miller et al.

[11] Patent Number: 5,191,823

[45] Date of Patent: Mar. 9, 1993

[54] HYDRAULIC KNIFE ASSEMBLY WITH CROSS-CUT KNIFE

[75] Inventors: Thomas R. Miller; David E. Frickey, both of Caldwell, Id.

[73] Assignee: J. R. Simplot Company, Caldwell, Id.

[21] Appl. No.: 870,666

[22] Filed: Apr. 17, 1992

[51] Int. Cl.[5] ..... B26D 1/03

[52] U.S. Cl. ..... 83/857; 83/402; 83/858; 83/932

[58] Field of Search ..... 83/402, 857, 858, 98, 83/425.2, 425.3, 932, 856

[56] References Cited

U.S. PATENT DOCUMENTS

| | | | |
|---|---|---|---|
| 3,109,468 | 11/1963 | Lamb et al. . | |
| 3,116,772 | 1/1964 | Lamb et al. . | |
| 4,082,024 | 4/1978 | Hodges | 83/858 X |
| 4,372,184 | 2/1983 | Fisher et al. | 83/402 |
| 4,423,652 | 1/1984 | Winslow | 83/402 X |
| 4,766,793 | 8/1988 | Fischer et al. | 83/402 X |
| 5,009,141 | 4/1991 | Julian et al. | 83/402 X |

*Primary Examiner*—Frank T. Yost

*Assistant Examiner*—Rinaldi Rada

*Attorney, Agent, or Firm*—Kelly Bauersfeld & Lowry

[57] ABSTRACT

An improved hydraulic knife assembly is provided for cutting potatoes and the like, wherein the knife assembly includes a cross-cut knife used to facilitate removal of a stuck potato. The knife assembly comprises a grid of knife blades encased within a knife housing adapted for removable in-line mounting along a flow conduit. Potatoes are propelled through the flow conduit by an hydraulic flow stream for cutting engagement with the knife blades as the potatoes pass through the knife housing. In the event that a potato becomes stuck at an upstream side of the knife housing, the cross-cut knife is receivable through an open slot formed between the knife housing and the adjacent end of the flow conduit to sever the stuck potato and thereby permit substantially unobstructed disassembly of the knife housing from the flow conduit. The thus disassembled knife housing and flow conduit can then be cleared preparatory to re-assembly and resumed normal cutting operations.

7 Claims, 2 Drawing Sheets

FIG. 4
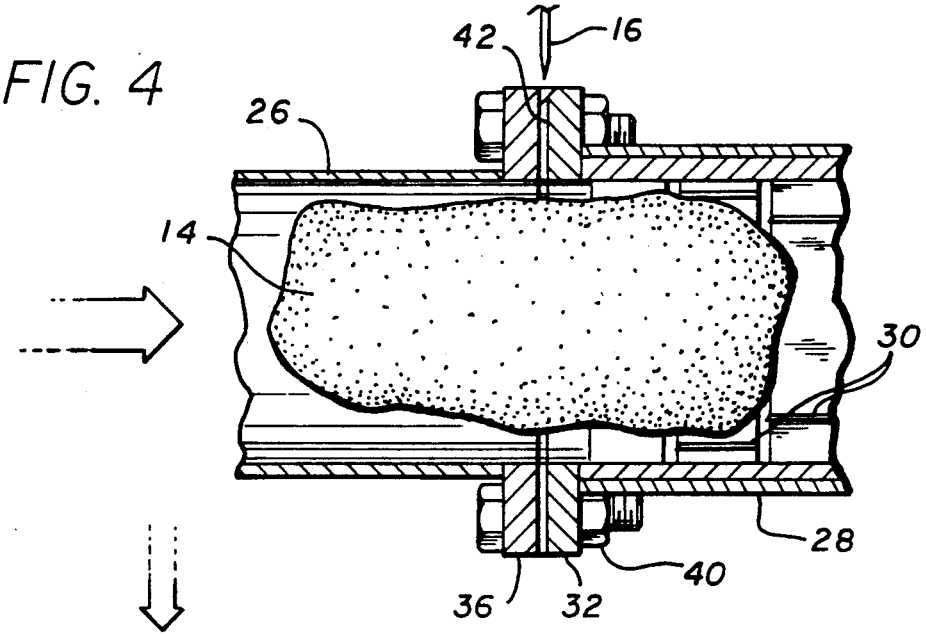
FIG. 5
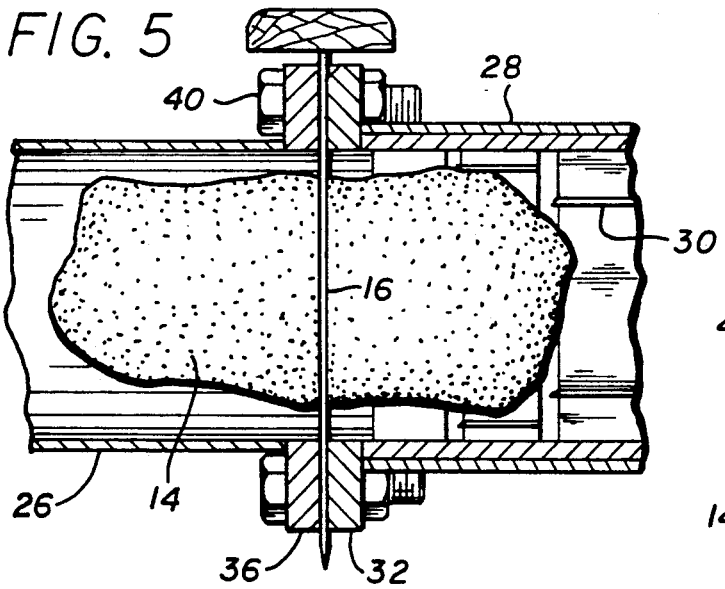
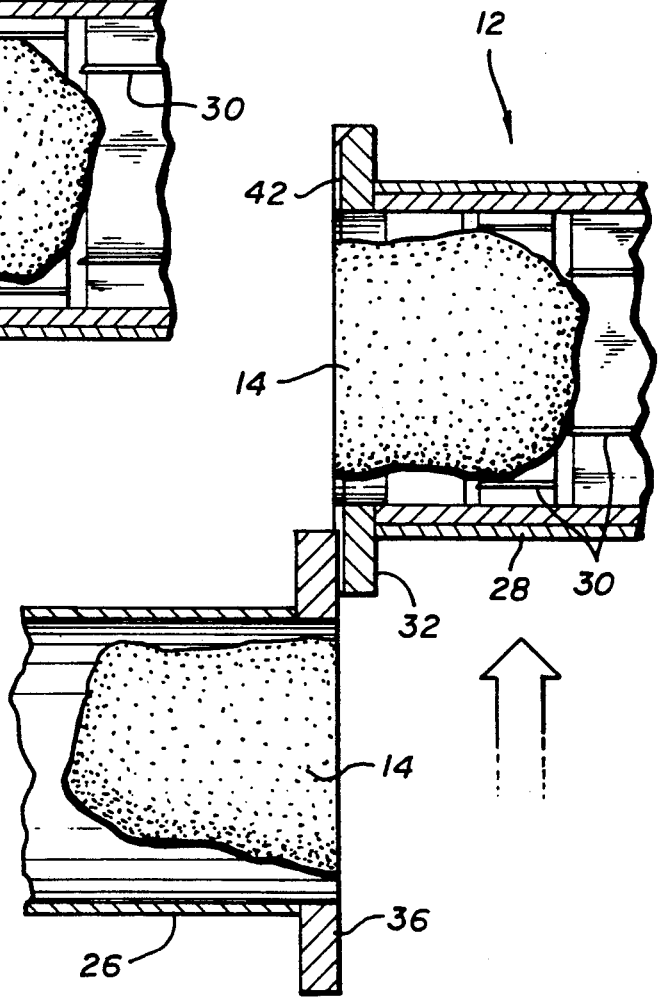
FIG. 6

HYDRAULIC KNIFE ASSEMBLY WITH CROSS-CUT KNIFE

BACKGROUND OF THE INVENTION

This invention relates generally to improvements in so-called hydraulic knife assemblies wherein a vegetable, such as a potato, is propelled by an hydraulic fluid into cutting engagement with knife blades positioned along a fluid flow path. More particularly, this invention relates to an improved hydraulic knife assembly having a cross-cut knife which can be moved across the flow path to sever a potato stuck therein, and thereby facilitate removal of the stuck potato so that normal cutting operation can be resumed.

Hydraulic knife assemblies in general are well known in the art, and typically comprise an array or grid of knife blades mounted along a flow path defined by an elongated tubular conduit. Pumping means are provided to entrain a vegetable product, such as a potato, with a propelling hydraulic fluid flow stream of relatively high velocity for flow through the conduit into cutting engagement with the knife blades. In production systems, vegetable products are pumped one at a time in relatively rapid succession with a propelling water stream for flow into and through the conduit, with the kinetic energy imparted to each product serving to drive the product past the knife blades. As a result, the vegetable products are cut into strips at a relatively rapid production rate, with the particular size and shape of the cut product strips being dictated by the geometry of the knife blades. For examples of hydraulic knife cutting assemblies of this general type used in production systems to cut potatoes into French fry strips, see U.S. Pat. Nos. 3,109,468; 3,116,772; and 4,423,652.

Hydraulic cutting systems of the type described above beneficially operate at relatively high production rates, whereby a substantial quantity of cut product can be generated in a relatively short period of time. However, on occasion, a vegetable product may be propelled into engagement with the knife blades with insufficient kinetic energy to carry the product through the knife assembly Instead, the product becomes jammed or stuck along the flow conduit at an upstream side of the knife blades, wherein the product blocks or obstructs passage of a succession of subsequent products pumped along the flow conduit.

In the past, a potato or the like lodged at the upstream side of the hydraulic knife assembly has required disassembly of a blade-carrying knife housing from a normal position mounted in-line with the tubular flow conduit. In this regard, the knife housing is normally separated from the flow conduit in a direction perpendicular to the product flow stream, for purposes of accessing and removing the stuck product. Unfortunately, a potato lodged at the upstream side of the knife blades typically bridges between the knife housing and the adjacent end of the flow conduit, such that the stuck potato obstructs knife housing removal. Substantial manual force has been necessary to separate the knife housing from the flow conduit, wherein this removal force must be sufficient to shear the stuck potato. The manual force required to remove the knife housing frequently exceeds the physical strength of many production line operators.

There exists, therefore, a significant need for improvements to hydraulic knife assemblies, particularly with respect to facilitating knife housing disassembly from a product flow conduit in the event that a product becomes stuck at the upstream side of the knife blades. The present invention fulfills this need and provides further related advantages.

SUMMARY OF THE INVENTION

In accordance with the invention, a hydraulic knife assembly is provided for use in cutting vegetable products, such as potatoes and the like, wherein the improved knife assembly includes a cross-cut knife for facilitated removal of a stuck potato.

The knife assembly comprises an array or grid of knife blades mounted within a knife housing adapted for in-line mounting along the length of a product flow conduit. The product to be cut, such as a potato, is propelled through the flow conduit by an hydraulic flow stream, normally with sufficient momentum to carry the product through the knife blades resulting in cut product strips at a downstream side of the knife housing.

In the event that the product becomes jammed or stuck at an upstream side of the knife blades, and thus does not pass through the knife housing, the cross-cut knife is provided to sever the stuck product for purposes of facilitating knife housing disassembly from the flow conduit. More particularly, the stuck product normally bridges between the knife housing and the adjacent flow conduit at the upstream side of the knife blades, such that the stuck product is in a position to obstruct disassembly of the knife housing from the flow conduit. An open side slot is formed between the knife housing and the adjacent end of the flow conduit at the upstream side of the knife blades for receiving the cross-cut knife in a direction transversely across the product flow path to sever the stuck product. The knife assembly can then be dissembled from the flow conduit quickly and easily to permit the knife assembly and flow conduit to be cleared and reassembled preparatory to resumed cutting operation.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings

FIG. 4 is a fragmented vertical sectional view of the knife assembly, illustrating a potato lodged at an upstream side of the knife assembly;

FIG. 5 is a fragmented vertical sectional view similar to FIG. 4, and illustrating use of the cross-cut knife to sever the stuck potato; and FIG. 6 is a fragmented vertical sectional view similar to FIGS. 4 and 5, and illustrating disassembly of the knife housing following severing of the stuck potato.

DETAILED DESCRIPTION OF THE PREFERRED EMBODIMENT

Figure 1:
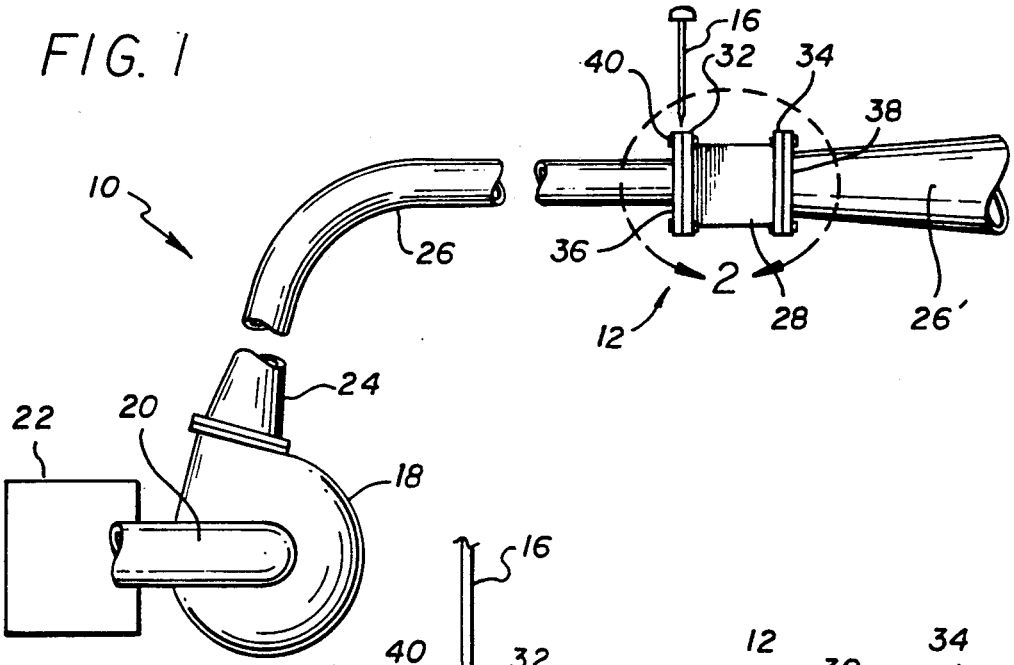
FIG. 1 is a schematic representation of an hydraulic cutting system including an improved hydraulic knife assembly with cross-cut knife, embodying the novel features of the invention.

As shown in the exemplary drawings, an hydraulic cutting system referred to generally in FIG. 1 by the reference numeral 10 includes an improved hydraulic knife assembly 12 for cutting vegetable products such a potatoes 14 and the like at a relatively high production high production rate. The knife assembly 12 includes a cross-cut knife 16 for use as needed to facilitate removal of one or more potatoes which have become stuck or jammed at an upstream side of the knife assembly 12.

The general overall construction and operation of the hydraulic cutting system 10 is relatively conventional in the art and is designed to propel any of a variety of products, such as vegetable products, and particularly potatoes, into cutting engagement with knife elements of the knife assembly 12. More specifically, and by way of background, the cutting system 10 includes a food pump 18 which is appropriately driven to draw in potatoes one at a time together with a propelling hydraulic fluid, such as water, through a pump inlet 20 coupled to a supply reservoir 22 of potatoes and water. The pump 18 accelerates the water to a relatively high velocity and discharges the water and potatoes through a pump outlet 24 to a tubular flow conduit 26. The high velocity water constitutes a propelling hydraulic fluid flow stream which carries and propels the potatoes one at a time into and through the flow conduit 26 for passage to the knife assembly 12. For convenience, the description herein will refer to the structure and operation of the knife assembly 12 for use in cutting potatoes 14 although it will be understood that the invention is applicable to cutting of other types of products.

Figure 2:
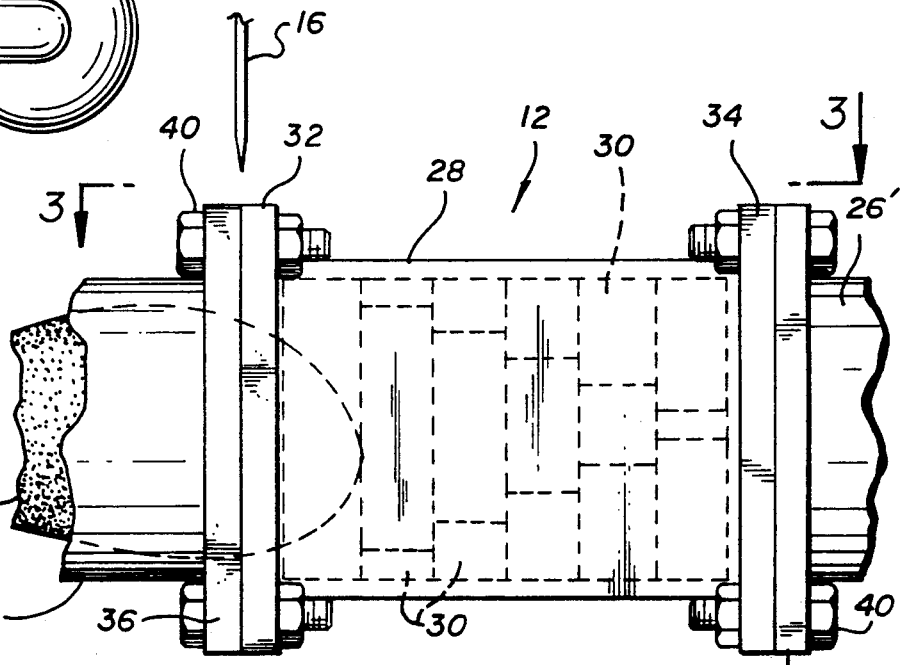
FIG. 2 is an enlarged fragmented side elevational view of the hydraulic knife assembly, corresponding generally with the encircled region 2 of FIG. 1.
Figure 3:
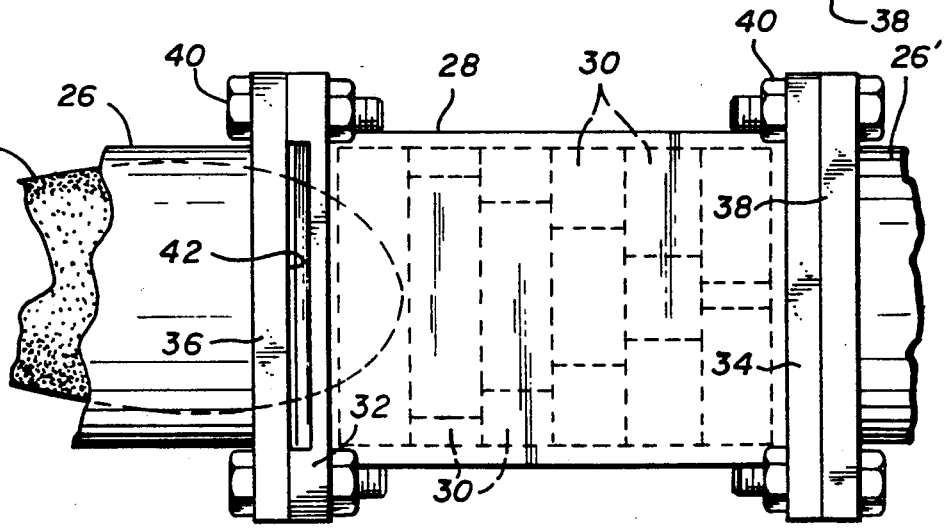
FIG. 3 is a fragmented top plan view taken generally on the line 3—3 of FIG. 2.

The knife assembly 12 comprises a knife housing 28 of cylindrical or other appropriate shape supporting an internally mounted array or grid of cutting blades 30 extending across an internal flow passage. Mounting means are provided on the knife housing 28 to permit removable in-line installation of the knife housing along the flow conduit 26, thereby orienting the cutting blades 30 with sharp cutting edges in an upstream direction to engage potatoes 14 propelled through the conduit. The illustrative drawings show a pair of end flanges 32 and 34 on the knife housing 28 for bolt-on attachment to mating end flanges 36 and 38, respectively, on the adjacent ends of the flow conduit 26. The knife assembly 12 is thus assembled in-line with the flow conduit 26 by sliding the housing 28 perpendicular to a central axis of the flow conduit to a position nested between the conduit flanges 36, 38. A plurality of bolts 40 are provided at the upstream and downstream ends of the knife housing for secure attachment to the conduit flanges 36, 38 (FIGS. 2 and 3).

The cutting blades 30 may be oriented in various geometric patterns for cutting the potatoes propelled through the flow conduit 26. In this regard, hydraulic knife assemblies of this general type have been widely used for cutting potatoes into elongated potato strips for use as French fries. For examples of cutting blade patterns, see U.S. Pat. Nos. 3,109,468; 3,116,772, and 4,423,652, which are incorporated by reference herein. The propelling water stream pumped through the flow conduit 26 is designed to impart sufficient momentum or kinetic energy to the potatoes 14 for flow-through passage through the knife housing 28, in cutting engagement with the blades 30, resulting in cut product strips at a downstream section 26' of the flow conduit.

On occasion, a particular potato 14 may possess insufficient momentum for flow-through passage through the knife housing 28. This occurrence is most commonly the result of a particularly large potato which is inadequately propelled by the flow stream, although various other factors may also contribute. When this occurs, the potato 14 typically engages the knife blades 30 at the upstream side thereof, with the potato stopping or sticking at a position bridging the assembly joint or plane between the upstream end of the knife housing 28, and the adjacent downstream end of the flow conduit 26, as shown in FIG. 4. In this position, the potato blocks passage of subsequent potatoes into and through the flow conduit 26, resulting in a rapid build-up of potatoes lined end-to-end and jammed within the flow conduit.

In accordance with the present invention, the end flange 32 at the upstream end of the knife housing 28 is formed with an elongated side slot 42 milled into an end face thereof with a sufficient width to span the internal flow passage defined by the flow conduit 26 and knife housing 28. This narrow open slot 42 is sized and shaped for manual insertion of the cross-cut knife 16. As shown in FIGS. 4 and 5, the cross-cut knife 16 can be inserted into the slot 42 and manually thrust transversely across the product flow passage at a position substantially conforming with the joint between the knife housing 28 and the flow conduit 26, for purposes of severing the potato 14 lodged at that location. The cross-cut knife 16 is then withdrawn from the slot 42. The knife housing 28 can be disassembled from the flow conduit 26 by removal of the bolts 40, and separation of the knife housing in a direction perpendicular to the product flow path, as shown in FIG. 6. Such removal of the knife housing 28 exposes the interior of the knife housing and the flow conduit 26 for easy removal of the severed portions of the stuck potato 14. In addition, potatoes trapped within the flow conduit 26 at a location upstream from the stuck potato can also be cleared quickly and easily. The knife housing 28 can then be reassembled with the flow conduit 26, and cutting production resumed.

The improved hydraulic knife assembly 12 of the present invention thus permits disassembly of the knife housing 28 from the flow conduit 26 quickly and easily, and substantially without obstruction by a potato stuck at the knife housing inlet. Substantial manual effort necessary to shear the stuck potato, in conjunction with disassembly of the knife housing, is not required.

A variety of modifications and improvements to the hydraulic knife assembly of the present invention will be apparent to those skilled in the art. Accordingly, no limitation on the invention is intended by way of the foregoing description and accompanying drawings, except as set forth in the appended claims.

We claim:

1. An hydraulic knife assembly for removable in-line mounting to a flow conduit adapted for passage of a product to be cut, wherein the product is propelled through the flow conduit by an hydraulic flow stream, said knife assembly comprising:

a knife housing defining an internal flow passage extending along a first direction;

an array of knife blades mounted within said knife housing to extend across said flow passage and defining cutting edges presented in an upstream direction;

means for removably mounting said knife housing in-line with said flow conduit, for flow-through passage of the product to be cut and the propelling hydraulic flow stream through said internal flow passage whereby the product is cut by said knife blades into strips;

means defining a transversely open slot disposed generally at an upstream end of said knife housing, said slot being oriented generally perpendicular to said first direction; and a cross-cut knife having a size and shape for reception into said slot, to extend from a position outside said internal flow passage through said slot and into said internal flow passage, and to be thrust in a direction generally transversely across and generally perpendicular to said internal flow passage to sever a product lodged at an upstream side of said knife blades along a plane oriented generally perpendicular to said first direction.

2. The hydraulic knife assembly of claim 1 wherein said means for removably mounting said knife housing comprises means for removing said knife housing from the flow conduit in a direction generally perpendicular to the direction of product flow through the flow conduit.

3. In an hydraulic cutting system including an hydraulic flow path, an hydraulic knife assembly removably mounted in-line with the hydraulic flow path and defining cutting edges presented in an upstream direction, and means for propelling a product to be cut through the flow path for pass-through cutting engagement with the knife assembly, the improvement comprising:

means defining a transversely open slot disposed generally at an upstream end of the knife assembly, said slot being oriented generally perpendicular to said flow path; and a cross-cut knife having a size and shape for reception into said slot, to extend from a position outside they hydraulic flow path through said slot and into said hydraulic flow path, and to be thrust in a direction generally transversely across and generally perpendicular to the flow path at the upstream end of the knife assembly to sever a product lodged at the upstream end of the knife assembly along a plane oriented generally perpendicular to said flow path.

4. An hydraulic cutting system, comprising:

an elongated flow conduit;

means for pumping a product to be cut together with a propelling hydraulic flow stream through said flow conduit;

an hydraulic knife assembly having a knife housing defining an internal flow passage having a longitudinal axis, and an array of knife blades mounted within said knife housing to extend across said internal flow passage, said knife blades having cutting edges presented in an upstream direction;

means for removably mounting said knife housing in-line with said flow conduit for flow-through passage of the product to be cut through said internal flow passage, whereby the product is cut by said knife blades into longitudinally elongated strips;

means defining a transversely open slot disposed generally at an upstream end of said knife housing, said slot being oriented generally perpendicular to said longitudinal axis; and a cross-cut knife having a size and shape for reception into said slot, to extend from a position outside said internal flow passage through said slot and into said internal flow passage, and to be thrust in a direction generally transversely across and generally perpendicular to said internal flow passage while said knife housing is mounted in-line with said flow conduit to sever a product lodged at an upstream side of said knife blades along a plane generally perpendicular to said longitudinal axis.

5. The hydraulic cutting system of claim 4 wherein said means for removably mounting said knife housing comprises means for removing said knife housing from the flow conduit in a direction generally perpendicular to the direction of product flow through the flow conduit.

6. The hydraulic cutting system of claim 4 wherein said means for removably mounting said knife housing comprising a pair of mating end flanges formed respectively on said knife housing and said flow conduit, and bolt means removably interconnecting said end flanges.

7. The hydraulic cutting system of claim 6 wherein said mating end flanges cooperatively define said slot.

* * * * *